US007185462B1

(12) United States Patent
Smelser

(10) Patent No.: US 7,185,462 B1
(45) Date of Patent: Mar. 6, 2007

(54) DOUBLE CORE BRACE

(75) Inventor: James Smelser, Sandy, UT (US)

(73) Assignee: SME Steel Contractors, Inc., West Jordan, UT (US)

( * ) Notice: Subject to any disclaimer, the term of this patent is extended or adjusted under 35 U.S.C. 154(b) by 268 days.

(21) Appl. No.: 10/628,027

(22) Filed: Jul. 25, 2003

(51) Int. Cl.
*E04B 1/98* (2006.01)
*E04H 9/02* (2006.01)

(52) U.S. Cl. ..... 52/167.3; 52/167.1; 52/638; 52/724.5

(58) Field of Classification Search ..... 52/167.1, 52/167.3, 638, 642, 693, 695, 724.5; 405/229; 188/371, 378
See application file for complete search history.

(56) References Cited

U.S. PATENT DOCUMENTS

| | | | | |
|---|---|---|---|---|
| 3,232,638 | A | 2/1966 | Hollander | 285/55 |
| 5,175,972 | A | 1/1993 | Sridhara | 52/727 |
| 5,471,810 | A | 12/1995 | Sugisawa et al. | 52/731.7 |
| 6,530,182 | B2 * | 3/2003 | Fanucci et al. | 52/167.3 |
| 6,826,874 | B2 * | 12/2004 | Takeuchi et al. | 52/167.3 |
| 6,837,010 | B2 * | 1/2005 | Powell et al. | 52/167.3 |
| 2001/0000840 | A1 | 5/2001 | Takeuchi et al. | |

FOREIGN PATENT DOCUMENTS

| | | |
|---|---|---|
| IN | 155036 | 7/1982 |
| JP | 1-187271 | 7/1989 |
| JP | 3-199542 | 8/1991 |
| JP | 3-199581 | 8/1991 |
| JP | 3-199582 | 8/1991 |
| JP | 3-262881 | 11/1991 |
| JP | 4-70438 | 3/1992 |
| JP | 4-19121 | 4/1992 |
| JP | 5-9977 | 1/1993 |
| JP | 5-71242 | 3/1993 |
| JP | 5-133137 | 5/1993 |
| JP | 5-57110 | 7/1993 |

(Continued)

OTHER PUBLICATIONS

Nippon Steel Corp., Steel Structure Div., Toykyo Japan, "Unbonded Brace" (Applicant makes no claim that this is prior art and have no idea when the brochure was published).

(Continued)

*Primary Examiner*—Winnie Yip
(74) *Attorney, Agent, or Firm*—Craig Metcalf; Snell & Wilmer

(57) ABSTRACT

The present invention relates to structural braces. More particularly, the present invention relates to a brace apparatus that has an effective length capable of undergoing plastic deformation that is greater than the length of the brace apparatus. The brace apparatus has a first core member having a deformable region of an effective deformable length and a second core member having a deformable region of an effective deformable length. The total effective deformable length of the brace apparatus is the sum of the effective deformable length of the first core member and the second core member. This allows the brace apparatus to have a greater deformable length relative to the length and size of the brace. Additionally, the greater deformable length reduces the strain on the core members enabling the brace apparatus to undergo a greater amount of deformation for a larger number of total cycles without buckling the brace.

27 Claims, 6 Drawing Sheets

FOREIGN PATENT DOCUMENTS

| | | | |
|---|---|---|---|
| JP | 5-57111 | | 7/1993 |
| JP | 7-229204 | | 8/1995 |
| JP | 7-324377 | | 12/1995 |
| JP | 7-324378 | | 12/1995 |
| JP | 9-221830 | | 8/1997 |
| JP | 9-328813 | | 12/1997 |
| JP | 10-110470 | | 4/1998 |
| JP | 10-306498 | | 11/1998 |
| JP | 11-29978 | | 2/1999 |
| JP | 11-29987 | | 2/1999 |
| JP | 11-117404 | | 4/1999 |
| JP | 11-153194 | | 6/1999 |
| JP | 11-159010 | | 6/1999 |
| JP | 11-172783 | | 6/1999 |
| JP | 11-172784 | | 6/1999 |
| JP | 11-280294 | | 10/1999 |
| JP | 2000-27292 | | 1/2000 |
| JP | 2000-27293 | * | 1/2000 |
| JP | 2000-45562 | | 2/2000 |
| JP | 2000-96867 | | 4/2000 |
| JP | 2000-110257 | | 4/2000 |
| JP | 2000-144900 | | 5/2000 |
| JP | 2000-186372 | | 7/2000 |
| JP | 2000-265602 | | 9/2000 |
| JP | 2000-265706 | | 9/2000 |
| JP | 2000-328669 | | 11/2000 |
| JP | 2001-132112 | | 5/2001 |
| JP | 2001-140340 | * | 5/2001 |
| JP | 2001-182359 | * | 7/2001 |
| JP | 2001-214541 | | 8/2001 |
| JP | 2001-227192 | | 8/2001 |
| JP | 2002-173982 | * | 6/2002 |
| JP | 5-3402 | | 1/2003 |

OTHER PUBLICATIONS

"Fully Braced for Seismic Survival," Engineering, Jul. 19, 1997, pp. 34-36.

Nippon Steel Corp., Building Construction and Urban Development Divs., Engineering Business Organization (to the best of Applicant's knowledge and belief, this reference was published at least as early as 1998).

Tube Investment of India LTD, A Report on the New Concept of Sleeved Column and its Applications, Aug. 28, 2001 (While applicant is not aware if or when this reference may have been published, to the best of the applicant's knowledge and belief, this reference was published prior to the date of the above referenced patent.).

Eric Ko, Andrew Mole, Ian Aiken, Frederick Tajirian, Zigmund Rubel and Isao Kimura, Application of the Unbonded Brace in Medical Facilities, Jul. 2002 (While applicant is not aware if or when this reference may have been published, to the best of the applicant's knowledge and belief, this reference was published prior to the date of the above referenced patent.).

Parry Brow, S.E., Ian D. Aiken, Ph.D., P.E., F. Jeff Jafarzadeh, P.E., Seismic Retrofit of the Wallace F. Bennett Federal Building, Aug. 2001.

Ian D. Aiken and Isao Kimura, The Use of Buckling-Restrained Braces in the United States (While applicant is not aware if or when this reference may have been published, to the best of the applicant's knowledge and belief, this reference was published prior to the date of the above referenced patent.).

David B. Rosenbaum, 'New' Seismic-Resistant System Finally Gets Warm U.S. Welcome, Jun. 3, 2002.

Gil Davis, Catch the next Wave, Apr. 2002.

Rafael Sabelli, Stephen Mahin and Chunho Chang, Seismic Demands on Steel Braced Frame Buildings with Buckling-Restrained Braces (While applicant is not aware if or when this reference may have been published, to the best of the applicant's knowledge and belief, this reference was published prior to the date of the above referenced patent.).

Atsushi Watanabe, Yasuyoshi Hitomi, Eilchiro Saeki, Akira Wada, and Morihisa Pujimoto, Properties of Brace Encased in Buckling-Restraining Concrete and Steel Tube, Aug. 1988 (While applicant is not aware of the exact date of publication, to the best of the applicant's knowledge and belief this reference was published prior to the filing date of the above referenced application).

Peter Clark, Ian Aiken, Kazuhiko Kasai, Eric Ko, and Isao Kimura, Design Procedures for Buildings Incorporating Hysteretic Damping Devices, Oct. 1999 (While applicant is not aware of the exact date of publication, to the best of applicant's knowledge and belief this reference was published prior to the filing date of the above referenced application).

* cited by examiner

DOUBLE CORE BRACE

BACKGROUND OF THE INVENTION

1. The Field of the Invention

The present invention relates to structural braces. More particularly, the present invention relates to structural braces adapted to absorb seismic magnitude forces by undergoing plastic deformation while maintaining the structural integrity of the frame structure.

2. The Relevant Technology

For decades steel frame structures have been a mainstay in the construction of everything from low-rise apartment buildings to enormous skyscrapers dominating modern city sky lines. The strength and versatility of steel is one reason for the lasting popularity of steel as a building material. In recent years, steel frame structures have been the focus of new innovation. Much of this innovation is directed to minimize the effects of earthquakes on steel frame structures. Earthquakes provide a unique challenge to building construction due to the magnitude of the forces that can be exerted on the frame of the building. A variety of building techniques have been utilized to minimize the impact of seismic forces exerted on buildings during an earthquake.

One mechanism that has been developed to minimize the impact of seismic forces on buildings are structural braces that are adapted to absorb seismic energy through plastic deformation. While the braces are adapted to absorb energy by plastic deformation, they are also configured to resist buckling. While several embodiments of these energy absorbing braces exist, one popular design incorporates a steel core and a concrete filled bracing element. The steel core includes a yielding portion adapted to undergo plastic deformation when subjected to seismic magnitude forces. Compressive and/or tensile forces experienced during an earthquake are absorbed by compression or elongation of the steel core. While the strength of the steel core will decrease as a result of buckling, the concrete filled bracing element provides the required rigidity to limit this buckling to allow the structural brace to provide structural support. In short, the steel core is adapted to dissipate seismic energy while the concrete filled bracing element is adapted to maintain the integrity of the structural brace when the steel core is deformed. The use of energy absorbing braces allows a building to absorb the seismic energy experienced during an earthquake. This permits buildings to be designed and manufactured with lighter, less massive, and less expensive structural members while maintaining the building's ability to withstand forces produced during an earthquake.

Energy absorbing braces provide a functional aspect that is often independent of aesthetic or architectural details of the building. For example, the seismic load to be absorbed by a brace can dictate brace dimensions that are contrary to a span desired for the building's architecture. This is particularly problematic where the dimensions of the brace, as dictated by the seismic load to be carried, are much larger and/or longer than the frame dimensions where the brace is to be positioned. The conflict of design elements and seismic load can be a seemingly irretractable problem in existing architecture. This is because such seismic loads were not often considered in the design of older buildings. Due to the demand for seismic retrofitting of existing structures, the challenges presented by the interplay of design details and seismic needs can make a seismic retrofitting of an existing building either impractical or overly expensive.

The seismic load capacity of bearing braces can also be affected where the architectural details of the building dictate the dimensions of the bearing brace rather than seismic factors. The load capacity of a bearing brace is dictated by a variety of factors including the length and cross-sectional area of the core member undergoing plastic deformation. For example, where the bearing brace is of a small length and width to accommodate a smaller span in the building framework, the number and magnitude of cycles that can be experienced during a seismic event without resulting in failure of the brace are substantially limited.

BRIEF SUMMARY OF THE INVENTION

The present invention relates to structural braces. More particularly, the present invention relates to a brace apparatus that is able to absorb a greater seismic load relative to the size of the brace is disclosed. The brace apparatus has an effective length capable of undergoing plastic deformation that is greater than the length of the brace apparatus. The brace apparatus includes a first core member having a deformable region of an effective deformable length and a second core member having a deformable region of an effective deformable length. The total effective deformable length of the brace apparatus is the sum of the effective deformable length of the first core member and the second core member. This allows the brace apparatus to have a greater deformable length relative to the length and size of the brace. Additionally, the greater deformable length reduces the strain on the core members enabling the brace apparatus to undergo a greater amount of deformation for a larger number of total cycles without buckling the brace. Additionally, the buckling restraining assembly can include one or more bearings located proximal the core member. The bearings are adapted to minimize friction between the core member and the buckling restraining apparatus. Air gaps can also be positioned between the core members and the one or more bearings of the buckling restraining apparatus to prevent bonding of the core member and buckling restraining assembly.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to structural braces. More particularly, the present invention relates to a brace apparatus that has an effective length capable of undergoing plastic deformation that is greater than the length of the brace apparatus. The brace apparatus has a first core member having a deformable region of an effective deformable length and a second core member having a deformable region of an effective deformable length. The total effective deformable length of the brace apparatus is the sum of the effective deformable length of the first core member and the second core member. This allows the brace apparatus to have a greater deformable length relative to the length and size of the brace. Additionally, the greater deformable length reduces the strain on the core members enabling the brace apparatus to undergo a greater amount of deformation for a larger number of total cycles without buckling the brace.

Figure 1:
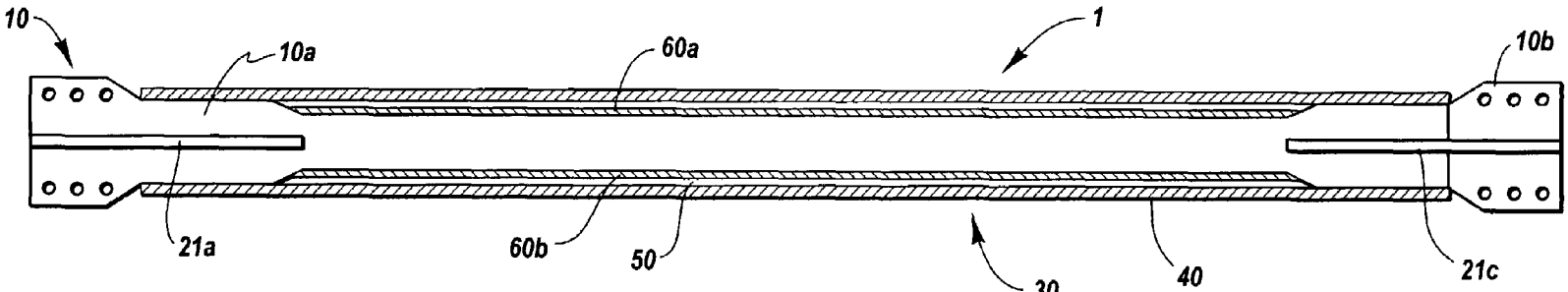
FIG. 1 is a cross-sectional side view illustrating the brace apparatus having a first and second core member according to one aspect of the present invention.

FIG. 1 is a cross sectional-side view of a brace apparatus 1 according to one aspect of the present invention. Brace apparatus 1 absorbs seismic magnitude forces by undergoing plastic deformation while maintaining the structural integrity of the brace. Brace apparatus 1 is capable of undergoing a greater amount of deformation and absorbing a greater amount of seismic energy for a given length of brace by utilizing a first and second core member.

In the illustrated embodiment, brace apparatus 1 comprises a first core member 10*a*, a second core member 10*b*, and a buckling restraining assembly 30. First core member 10*a* and second core member 10*b* are adapted to absorb seismic or other forces exerted on brace apparatus 1. First core member 10*a* and second core member 10*b* are designed to undergo plastic deformation to absorb forces encountered during a seismic or other event having forces of similar magnitude. First core member 10*a* and second core member 10*b* each have a deformable region which have a given deformation capacity. The effective length of brace apparatus 1 capable of undergoing plastic deformation is the sum of the length of the deformable region of the first core member 10*a* and the length of the deformable region of the second core member 10*b*. Brace apparatus 1 also has a total deformation capacity that is the sum of the deformation capacity of first core member 10*a* and the deformation capacity of second core member 10*b*.

Buckling restraining assembly 30 provides support to first and second core members 10*a, b*. The additional support provided by buckling restraining assembly 30 allows first and second core members 10*a, b* to absorb large amounts of energy by undergoing plastic deformation while providing the strength necessary to maintain the structural integrity of brace apparatus 1. In the illustrated embodiment, buckling restraining assembly 30 comprises a rigid layer 50, a support tube 40, bearing members (e.g. 60*a, b*), and lateral supports (e.g. 21*a, c*). In the illustrated embodiment, support tube 40 comprises a metal tube positioned external to rigid layer 50. Support tube 40 provides strength and flexibility to buckling restraining assembly. Additionally, support tube 40 encloses the other components of buckling restraining assembly 30. As will be appreciated by those skilled in the art a variety of types and configurations of support tubes can be utilized without departing from the scope and spirit of the present invention. For example, in one embodiment the support tube has a cylindrical configuration. In an alternative embodiment, the support tube comprises a plurality of planar elements that are coupled utilizing a weld, fastener, or some other bond.

Rigid layer 50 is located internal to support tube 40. Rigid layer 50 provides rigidity to buckling restraining assembly 30 to maintain the structural integrity of brace apparatus 1 when core member 10 undergoes plastic deformation. A variety of types and configurations of materials can comprise rigid layer 50. In one embodiment, the rigid layer comprises a cementious layer. In an alternative embodiment, the rigid layer is comprised of a foam material. In yet another embodiment the rigid layer is comprised of a polymer material. In an alternative embodiment, the rigid layer is comprised of a material having sufficient shear strength to provide the required rigidity to the buckling restraining assembly.

In the illustrated embodiment, buckling restraining assembly 30 also includes a plurality of bearing members such as bearing members 60*a, b*. Bearing members 60*a, b* are positioned internal to rigid layer 50. Bearing members 60*a, b* are adapted to limit the amount of friction resulting from movement of part or all of first and second core members 10*a, b* relative to part or all of buckling restraining assembly 30. As will be appreciated by those skilled in the art, brace apparatus 1 can be constructed with or without including bearing members.

In the illustrated embodiment, brace apparatus 1 further comprises air gaps positioned between first and second core members 10*a, b* and buckling restraining assembly 30. The air gaps are configured to minimize contact between the plurality of bearing members and first and second core members 10*a, b* when there is little or no load exerted on brace apparatus 1. Additionally the air gaps limit friction that can be generated between first and second core members 10*a, b* and buckling restraining assembly 30 when first and second core members 10*a, b* undergo plastic deformation. A variety of types and configurations of air gaps can be utilized without departing from the scope and spirit of the present invention. In one embodiment, the width of the air gaps is designed to minimize friction between the core members and the buckling restraining assembly while also controlling deformation of the core members.

As will be appreciated by those skilled in the art, the amount of deformation of core members 10*a, b* during compression and tension cycles is the result of many factors including, but not limited to, the magnitude of forces exerted on brace apparatus 1. Moreover, elastic deformation can occur when the forces exerted on first and second core members 10*a, b* are insufficient to cause plastic deformation. The width of the air gaps minimizes contact between the plurality of bearing members and first and second core members 10*a, b* when there is little or no load on brace apparatus 1. Additionally the width of the air gaps limits the buckling of first and second core members 10*a, b* when forces sufficient to cause core member 10*a* to undergo elastic or plastic deformation are exerted on brace apparatus 1. A variety of widths of air gaps can be utilized without departing from the scope or spirit of the present invention. As previously mentioned, a variety of factors affect the desired width of the air gaps including but not limited to, the thickness of the first and second core members, the length of the first and second core members, the material properties of the first and second core members, and the like.

As will be appreciated by those skilled in the art, air gaps and bearing members can be used in combination or singly to minimize the friction between core member 10 and buckling restraining assembly 30. For example, in one embodiment, brace apparatus 1 includes air gaps but not bearing members. In an alternative embodiment, brace apparatus 1 includes bearing members but not air gaps. In yet another embodiment, bearing apparatus includes both air gaps and bearing members.

In the illustrated embodiment, a plurality of lateral supports such as lateral supports 21*a, c* are also utilized. Lateral supports 21*a, c* provide additional rigidity to first and second core members 10*a, b*. This prevents the core members from buckling in the lateral direction at the ends of support tube 40. As will be appreciated by those skilled in the art, a variety of types and configurations of lateral supports can be utilized without departing from the scope and spirit of the present invention.

Figure 2:
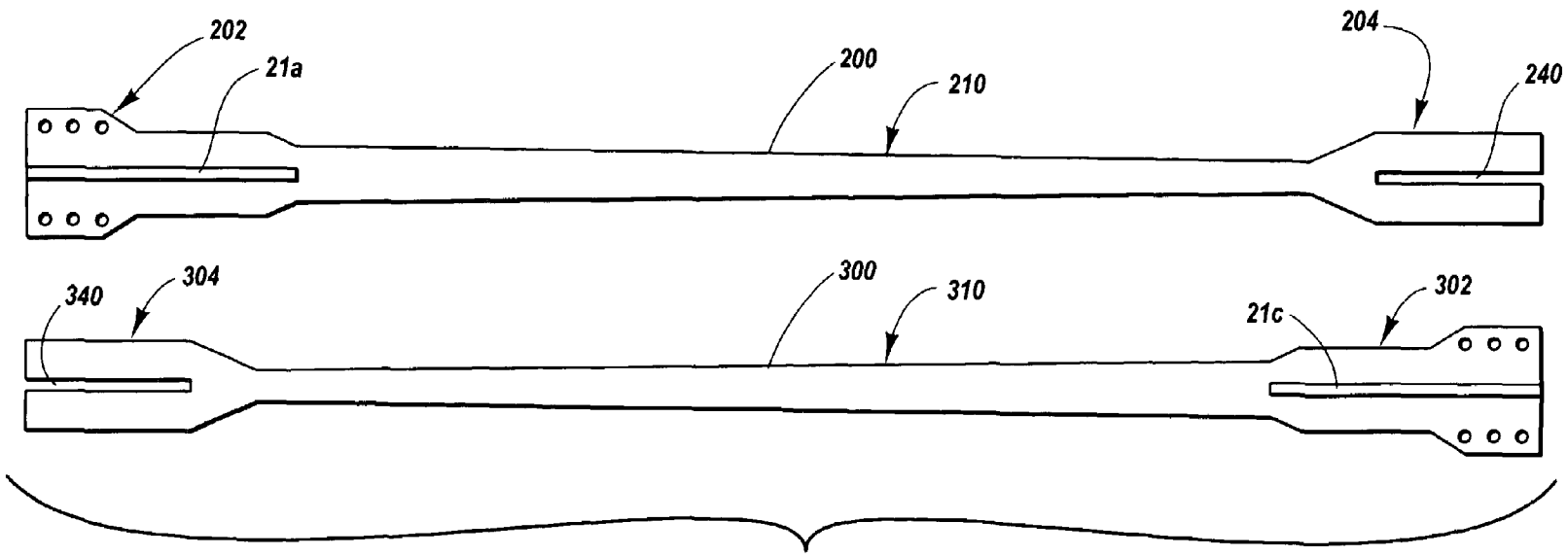
FIG. 2 illustrates the first and second core member in greater detail according to one aspect of the present invention.

FIG. 2 illustrates a first core member 200 and a second core member 300 in greater detail. First core member 200 can be utilized in place of first core member 10*a* of FIG. 1, while second core member 300 can be used in place of second core member 10*b* from FIG. 1. First core member 200 comprises a core member first end 202, a core member second end 204, and a core member deformable region 210.

Core member first end 202 is positioned external to buckling restraining assembly 30 of brace apparatus 1. Core member first end 202 includes a plurality of bores for attaching brace apparatus 1 to the frame structure of a building. Core member second end 204 is positioned internal to buckling restraining assembly 30. Core member second end 204 is adapted to be coupled to a first extremity of buckling restraining assembly 30. In one embodiment, core member second end is coupled directly to support tube 40. In an alternative embodiment, core member second end is coupled to rigid layer 50.

Core member deformable region 210 is positioned between core member first end 202 and core member second end 204. Core member deformable region 210 is adapted to undergo plastic deformation to absorb seismic magnitude forces exerted on brace apparatus 1. Core member deformable region 210 comprises the effective deformable length of first core member 200. The effective deformable length of core member deformable region 210 has a given deformation capacity. As will be appreciated by those skilled in the art, the deformation capacity of core member deformable region 210 is affected by a plurality of factors including, but not limited to, the length of the core member deformable region 210, the thickness of the core member deformable region 210, the materials from which core member deformable region is constructed, and the juxtaposition of core member deformable region 210 with buckling restraining assembly 30.

Second core member 300 comprises a core member first end 302, a core member second end 304, and a core member deformable region 310. Core member first end 302 is positioned external to buckling restraining assembly 30 of brace apparatus 1. Core member first end 302 includes a plurality of bores for attaching brace apparatus 1 to the frame structure of a building. Core member second end 304 is positioned internal to buckling restraining assembly 30. Core member second end 304 is adapted to be coupled to a first extremity of buckling restraining assembly 30. In one embodiment, core member second end is coupled directly to support tube 40. In an alternative embodiment, core member second end is coupled to rigid layer 50.

Core member deformable region 310 is positioned between core member first end 302 and core member second end 304. Core member deformable region 310 is adapted to undergo plastic deformation to absorb seismic magnitude forces exerted on brace apparatus 1. Core member deformable region 310 comprises the effective deformable length of second core member 300. The effective deformable length of core member deformable region 310 has a given deformation capacity. As will be appreciated by those skilled in the art, the deformation capacity of core member deformable region 310 is affected by a plurality of factors including, but not limited to, the length of the core member deformable region 310, the thickness of the core member deformable region 310, the materials from which core member deformable region is constructed, and the juxtaposition of core member deformable region 310 with buckling restraining assembly 30.

The position of first core member 200 relative to second core member 300 as shown in FIG. 2 illustrates the juxtaposition of first core member 200 relative to second core member 300 inside buckling restraining assembly 30. Core member first end 202 of first core member 200 is positioned adjacent core member second end 304 of second core member 300. Similarly, core member first end 302 of second core member 300 is positioned adjacent core member second end 204 of first core member 200.

As previously discussed, core member first end 202 of first core member 200 and core member first end 302 of second core member 300 are adapted to be coupled to the frame structure of a building. Core member second end 204 of first core member 200 and core member second end 304 of second core member 300 are coupled to buckling restraining assembly 30. Core member second end 204 and core member second end 304 prevent displacement of buckling restraining assembly 30 absent a seismic event or other phenomenon. When a seismic or similar event is experienced, core member first end 202 of first core member 200 and core member first end 302 of second core member 300 are alternatively pushed toward and away from each other resulting in compression and tension cycles.

The coupling of core member second end 204 of first core member 200 and core member second end 304 of second core member 300 to buckling restraining assembly 30 provides resistance to compression and tension cycles. As a result, during a tension cycle, in which core member first end 202 and core member first end 302 are pulled away from each other, the forces exerted by core member second end 204 and core member second end 304 on buckling restraining assembly can result in compressive forces being exerted on buckling restraining assembly 30. Where buckling restraining assembly 30 has a greater stiffness than core member deformable region 210 and core member deformable region 310 deformation of core member deformable region 210 and core member deformable region 310 results allowing core member first end 202 and core member first end 302 to move away from each other.

During a compression cycle core member first end 202 and core member first end 302 are pushed toward each other. The force exerted by core member second end 204 and core member second end 304 on buckling restraining assembly 30 results in tensile forces being exerted on buckling restraining assembly 30. Where buckling restraining assembly has a greater stiffness than core member deformable region 210 and core member deformable region 310 deformation of core member deformable region 210 and core member deformable region 310 results allowing core member first end 202 and core member first end 302 to move toward one another.

The effective deformable length of brace apparatus 1 is the sum of the length of core member deformable region 210 and core member deformable region 310. This is due to the fact that both core member deformable region 210 and core member deformable region 310 are undergoing plastic deformation in response to compressive and tensile forces exerted on the brace. This provides an overall effective deformable length of the brace apparatus that is longer than the actual length of the brace apparatus. By providing an effective deformable length that is longer than the actual length of the brace apparatus, the brace apparatus having a dual core can be used in smaller spans where a single core brace would be unable to provide the necessary deformation capacity. Additionally, by providing a greater affective deformable length for a shorter brace, the load is carried by the first and second core member providing greater longevity and reliability for brace apparatus 1. For additional details regarding the relationship of the effective deformable length of the brace apparatus and reliability of the brace refer to the discussion with reference to FIG. 7.

In the illustrated embodiment, core member deformable region 210 and core member deformable region 310 have a variable width. The portion of core member deformable region 210 adjacent core member second end 204 is more narrow than the portion of core member deformable region 210 adjacent core member first end 202. The portion of core member deformable region 310 adjacent core member second end 304 is more narrow than the portion of core member deformable region 310 adjacent core member first end 302. The variable width of core member deformable region 210 and core member deformable region 310 controls deformation of the core member deformable regions 210 and 310 to prevent premature restriction of the effective length of core member deformable regions 210 and 310.

As seismic magnitude forces are exerted on core member deformable regions 210 and 310, portions of core member deformable regions 210 and 310 undergo plastic deformation. The portions of core member deformable regions 210 and 310 first to undergo plastic deformation are the portions having the smallest cross-sectional area. This is due to the fact that the amount of force required to create a given amount of deformation is affected by of the cross-sectional area of the core member middle portion. As larger sections of the core member deformable regions 210 and 310 begin to undergo plastic deformation, the greatest amount of deformation will occur at the portion of the core member deformable regions 210 and 310 having the smallest cross-sectional area.

When a given amount of deformation is exceeded, one or more sections of core member deformable regions 210 and 310 bind to the buckling restraining assembly. Due to the variable width of core member deformable regions 210 and 310 the portions of core member deformable regions 210 and 310 to bind with the buckling restraining assembly are the portions having the smallest cross-sectional area. When a segment of the core member deformable regions 210 and 310 bind with the buckling restraining assembly, the effective length of the core member deformable regions undergoing plastic deformation is shortened. While the effective length of the core member deformable regions 210 and 310 is shortened, the amount of energy to be absorbed is unchanged. As a result, a greater amount of energy must be absorbed per unit length of core member deformable region. This can result in greater stress on core member deformable regions 210 and 310.

The controlled deformation resulting from the variable width of core member deformable regions 210 and 310 prevents premature restriction of the effective length of the portions of core member deformable regions 210 and 310 undergoing plastic deformation. Due to the variable width of the core member deformable regions 210 and 310, shortening of the core member deformable regions 210 and 310 occurs gradually from the second ends 204 and 304 to the first ends 202 and 302. As a result binding near the first ends 202 and 302 is prevented until portions closer to second ends 204 and 304 have bonded with the buckling restraining assembly. By preventing premature restriction of the effective length of the portion of core member deformable regions undergoing plastic deformation, premature failure of brace apparatus 1 is avoided. As will be appreciated by those skilled in the art, the core member deformable regions can have a variety of types of configurations without departing from the scope and spirit of the present invention.

Figure 3:
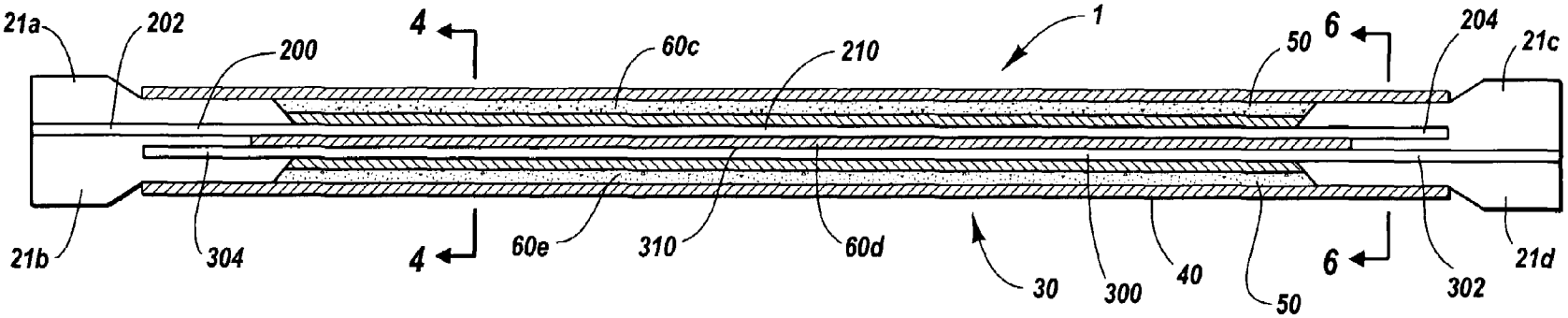
FIG. 3 is a top cross-sectional view illustrating the juxtaposition of the first core member relative to the second core member inside the buckling restraining assembly according to one aspect of the present invention.

FIG. 3 is a top cross-sectional view illustrating the juxtaposition of first core member 200 and second core member 300 in buckling restraining assembly 30 according to one aspect of the present invention. First core member 200 and second core member 300 are positioned on opposing sides of bearing member 60*d*. First core member 200 and second core member 300 are circumscribed by buckling restraining assembly 30. Core member first end 202 of first core member 200 is positioned external to buckling restraining assembly 30. Similarly, core member first end 302 of second core member 300 is positioned external to buckling retraining assembly 20.

Lateral supports 21*a* and 21*b* are coupled to core member first end 202 of first core member 200. Lateral supports 21*c* and 21*d* are coupled to core member second end 302 of second core member 300. Core member second end 204 of first core member 200 is positioned inside buckling restraining assembly 30 adjacent core member first end 302 of second core member 300. Similarly, core member second end 304 is positioned inside buckling restraining assembly 30 adjacent core member first end 202 of first core member 200.

Core member deformable regions 210 and 310 extended nearly the entire length of buckling restraining assembly 30. The effective length of the sum of core member deformable regions 210 and 310 is nearly double the length of buckling restraining assembly 30. Bearing members 60*c, d, e* are positioned adjacent core member deformable region 210 and core member deformable region 310. Bearing members 60*c, e* comprise lateral bearing members that prevent contact between rigid layer 50 and the sides of core member deformable region 210 and core member deformable region 310. Bearing member 60*d* is positioned between first core member 200 and second core member 300 to prevent contact, friction, and potential bonding of first core member 200 and second core member 300.

Slot void 240 of core member second end 204 allows core member second end 204 to be positioned adjacent to and on opposing sides of lateral support 21*b*. Slot void 340 permits core member second end 304 to be positioned adjacent to and on opposing sides of lateral support 21*c*.

Figure 4:
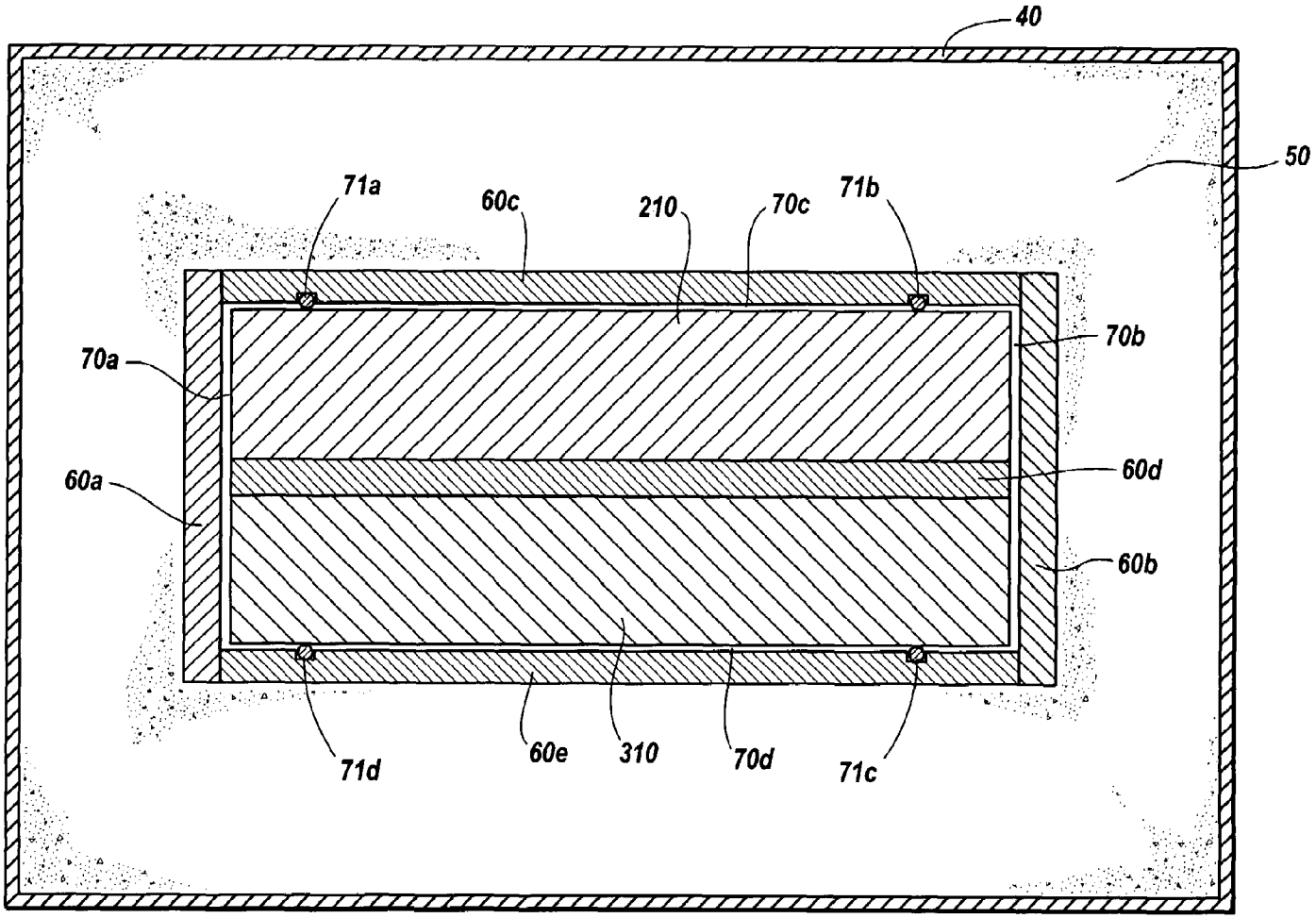
FIG. 4 is a cross-sectional view of illustrating the juxtaposition of the core members relative to other components of the brace apparatus.

FIG. 4 is a cross-sectional view of brace apparatus 1 taken along lines 4—4 of FIG. 3, illustrating the juxtaposition of core member deformable region 210 relative to core member deformable region 310. In the illustrated embodiment, the width of the cross section of core member deformable region 210 is substantially the same as the width of the cross section of core member deformable region 310.

A plurality of bearing members are positioned so as to circumscribe core member deformable region 210 and core member deformable region 310. Bearing members 60*a, b* comprise end cap members which protect the top and bottom of core member deformable region 210 and core member deformable region 310. Bearing members 60*c* and 60*e* comprise lateral bearings protecting the sides of core member deformable region 210 and core member deformable region 310. Bearing member 60*c* is positioned between core member deformable region 210 and core member deformable region 310.

In the illustrated embodiment, a plurality of air gaps 71*a–d* are positioned between bearing member 60*a, b, c, e*, core member deformable region 210, and core member deformable region 310. Air gaps 70*c* and 70*d* are created utilizing spacers 71*a–d* during manufacture of the brace. In one embodiment, spacers 71*a–d* are removed once rigid layer 50 is hardened. Air gaps 70*a* and 70*b* are created by positioning bearing members 60*a* and 60*b* on the ends of bearing members 60*c* and 60*e*. The length of bearing members 60*c* and 60*e* are slightly longer than the width of core member deformable region 210 and core member deformable region 310 to create the air gaps. In the illustrated embodiment, no air gap is provided between core member deformable region 210, bearing member 60*d*, and core member deformable region 310. This permits deformation of core member deformable region 210 and core member deformable region 310 primarily in a direction away from one another.

As will be appreciated by those skilled in the art a variety of types and configurations of bearing members, air gaps, and core member deformable regions can be utilized without departing from the scope and spirit of the present invention. For example, in one embodiment, an air gap is provided between the bearing member positioned between the core member deformable regions and the core member deformable regions. In an alternative embodiment, an air gap is utilized in place of a bearing member between the core member deformable regions.

Figure 5:
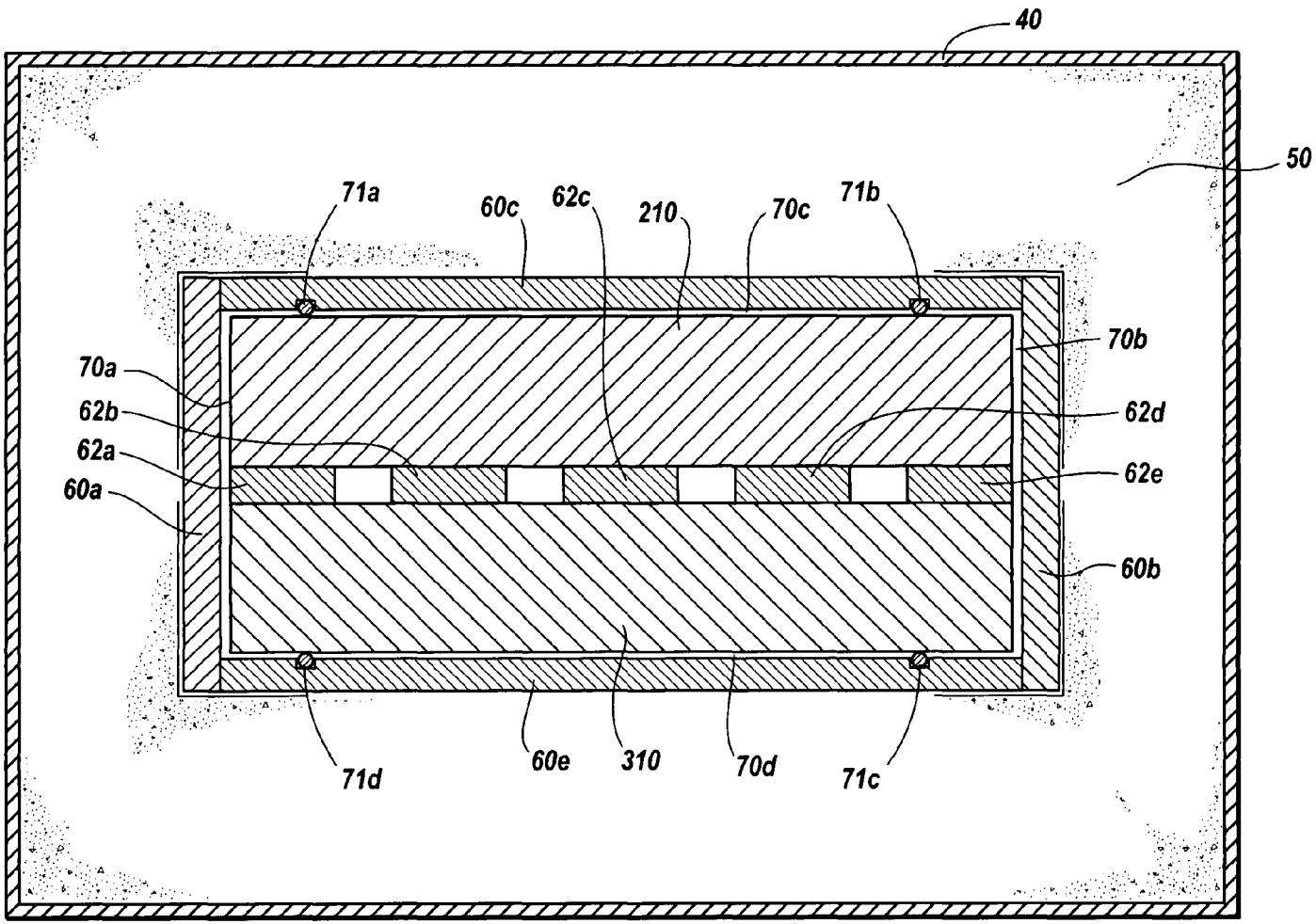
FIG. 5 is a cross-sectional view illustrating an alternative use of bearing members relative to the core members.

FIG. 5 is a cross-sectional view of brace apparatus 1 illustrating core member deformable region 210 and core member deformable region 310 according to an alternative embodiment of the present invention. In the illustrated embodiment, the plurality of bearing members 62*a, b, c, d, e* are positioned between core member deformable region 210 and core member deformable region 310. By utilizing a plurality of bearing members between core member deformable region 210 and core member deformable region 310 the bearing members can be more easily positioned between core member deformable region 210 and core member deformable region 310 during manufacture of the brace. Additionally, a smaller amount of bearing material is required providing costs savings and reducing the amount of bearing material required. The number and configuration of bearing members also facilitates movement of core member deformable region 210 relative to core member deformable region 310 during compression and tension cycles during seismic event.

Figure 6:
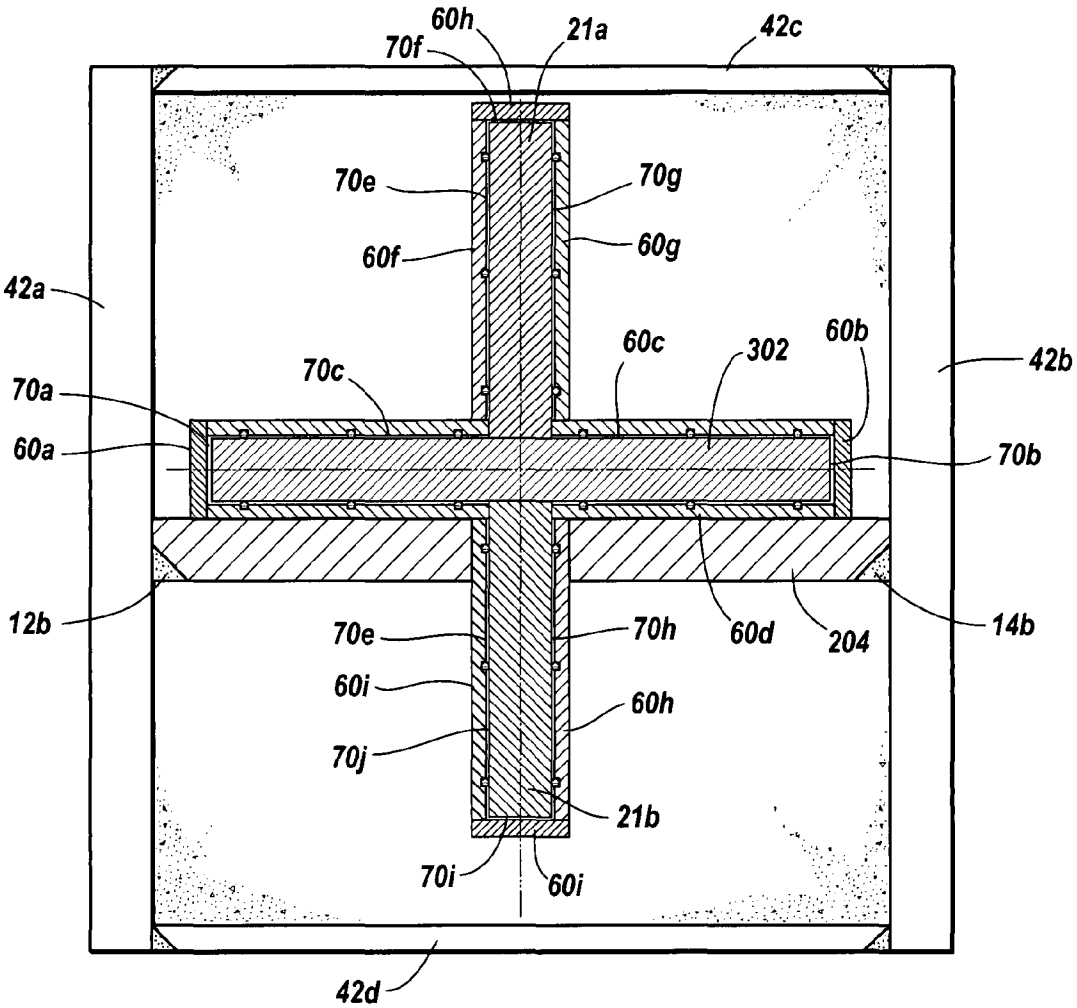
FIG. 6 is a cross-sectional view taken along an end portion of the brace apparatus according to one aspect of the present invention.

FIG. 6 is a cross-sectional end view of brace apparatus 1 taken along lines 6—6 of FIG. 3, illustrating core member first end 302 of second core member 300 and core member second end 204 of first core member 200. In the illustrated embodiments support tube 40 is comprised of side members 42*a, b*, top member 42*c*, and bottom member 42*d*. Side members 42*a, b* are welded to top member 42*c* and bottom member 42*d*. This facilitates construction and assembly of brace apparatus 1 particularly with respect to the positioning of bearing member 60*d* between first core member 200 and second core member 300.

In the illustrated embodiment, core member second end 204 of first core member 200 is welded directly to side members 42*a* and 42*b* at weld points 12*b* and 14*b*. Due to the compressive and tensile forces exerted on side members 42*a* and 42*b* by core member second end 204, side members 42*a* and 42*b* are substantially thicker and more massive than top member 42 and bottom member 42*a* so as to provide the requisite stiffness to support tube 40. As will be appreciated by those skilled in the art, a variety of types and configurations of bonding methods can be utilized to connect core member second end 204 to side members 42*a* and 42*b*.

A plurality of bearing members 60*a–i* are positioned around core member first end 302 and lateral supports 21*a* and 21*b*. Bearing member 60*a–i* reduced the friction between core member first end 302 and buckling restraining assembly 32 permitting unimpeded movement and plastic deformation of second core member 300. Additionally, a plurality of air gaps 70*a–j* are positioned between bearing members 60*a*–i, core member first end 302, lateral support 21*a* and lateral support 21*b*. Air gaps 70*a–j* and bearings members 60*a–i* are positioned adjacent core member first end 302, lateral supports 21*a*, and lateral support 21*b*. Core member second end 204 of first core member 200 is in direct contact with rigid layer 50 of buckling restraining assembly 30. This is due to the fact that core member second end 204 is meant to remain coupled to the illustrated extremity of buckling restraining assembly 30.

Figure 7:
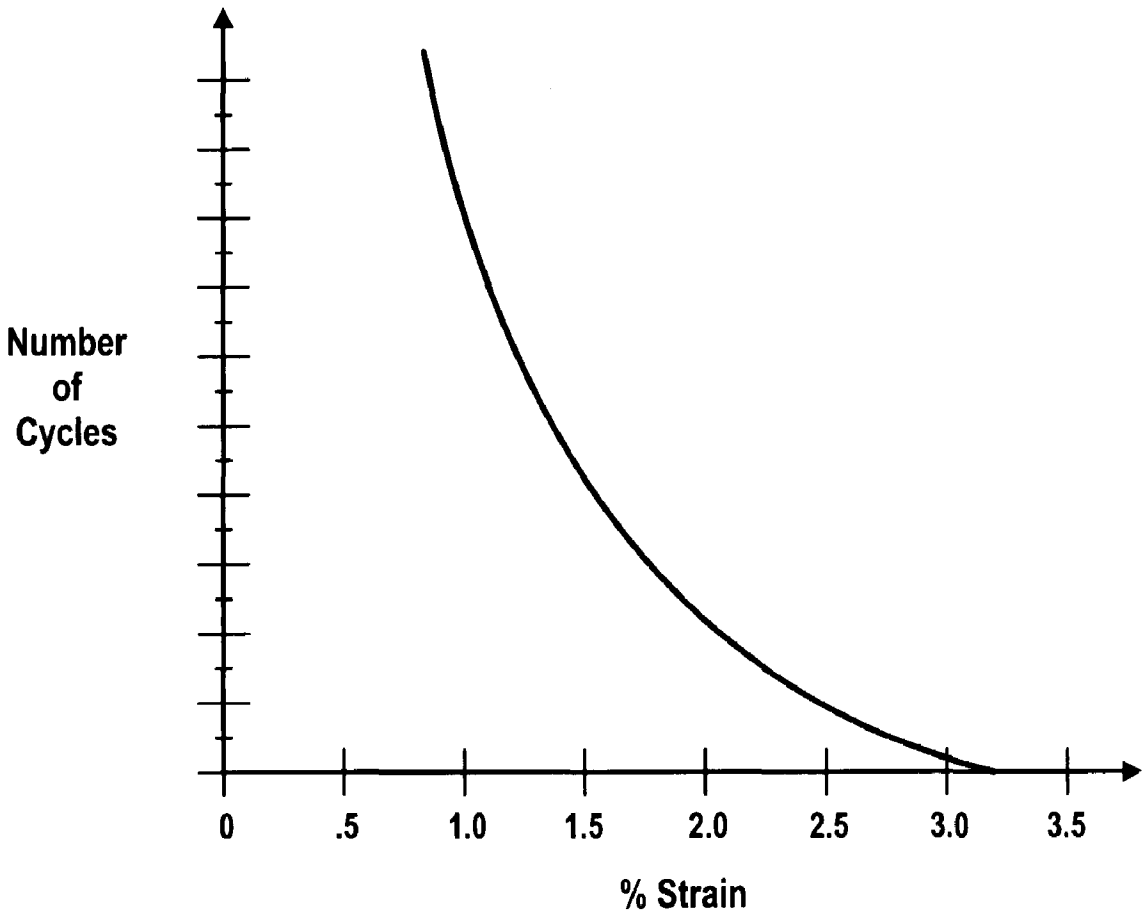
FIG. 7 is a line graph illustrating the relationship of the strain experienced on a core member and the number of cycles the core member can undergo prior to failure of the core member according to one aspect of the present invention.

FIG. 7 is a line graph illustrating the relationship of the strain exerted on the core member of brace apparatus 1 and the number of cycles the core member can undergo before failure. For the purposes of the present figure, strain is defined as the amount of variability in the length of the core member deformable region relative to the total length of the core member deformable region. For example, where the core member has a core member deformable region having a length of 100 inches a 1.5% strain would represent 1.5 inches of elongation or constriction of the length of the core member deformable region. As the strain exerted on brace apparatus 1 increases the number of cycles the core member can undergo before failure of the core member decreases.

Where the percentage of strain on the core member is in the realm of between 0.5 to 1% a large number of cycles can be experienced by the core member before core member failure. In contrast as the strain increases to between 2.5% and 3% the number of total cycles that could be experienced by the core member substantially decreases. Where the percent strain is between 1.5% and 2% an intermediate number of cycles can be experienced before failure of the brace is results. The line graph illustrates the contrast in reliability and longevity of the core member where the strain experienced on the core member is 1.5% as opposed to 3%.

The use of a double core brace in effect allows a user to reduce the percent strain experienced by the core member by ½ (i.e. from 3% to 1.5%) by doubling the effective length of the brace apparatus capable of undergoing plastic deformation. For example, for a single core brace having a core member deformable region of 100 inches, during a seismic event in which the core member deformable region is stretched and compressed by 3 inches a 3% strain is experienced by the core member deformable region and the core member will fail after a small number of cycles. By utilizing a double core brace having the same length of the brace apparatus of the previous example, an effective length of 200 inches of core member capable of undergoing plastic deformation is provided. During a seismic event of a similar magnitude the dual core member will undergo a total deformation of 3 inches. However, the same 3 inches represents a mere 1.5% percent strain in the 200 inches total core member deformable region. As a result, the core member can undergo a much larger number of cycles before failure.

Due to the small number of cycles experienced during a typical seismic event, the increased longevity of the core member allows the brace apparatus to undergo several seismic events before the brace apparatus needs to be replaced. Another affect of the dual core brace is that a much greater displacement or deformation capacity is provided by the brace. For example, a brace apparatus having 200 inches of total deformable region, the deformation capacity of the brace increases from 3 inches to 6 inches. This allows the core member to undergo a much large magnitude seismic event without resulting in immediate failure of the brace apparatus. Where a very large magnitude event results in a 6 inch displacement of the brace apparatus, a small number of cycles can be undergone without resulting failure of the brace apparatus. In contrast where a single core brace is utilized, the effective length of the brace apparatus capable of undergoing plastic deformation is limited to 100 inches and a 6 inch deformation would result in immediate failure of the brace apparatus. As will be appreciated by those skilled in the art, the line graph of FIG. 7 is provided for mere illustrative purposes and should not be considered to define nor limit the scope of the present invention. The actual strain, deformation capacity, and other parameters of the brace are a result of the actual properties of the brace and can vary based on the length, material properties, construction, thickness, and construction of both the core members and buckling restraining assembly.

It will also be appreciated that the brace of the present invention is not limited to a dual core structure. The principles of the present invention can be utilized to have a more than two core members to further multiply the effective deformable length of the brace apparatus. For example, a brace apparatus having four core members can be utilized providing approximately four times the deformable length and deformation and strain capacity of a single core brace having the same length.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A brace apparatus having an effective length capable of undergoing plastic deformation that is greater than the length of the brace apparatus, the brace apparatus comprising:

a plurality of core members;

a buckling restraining assembly enclosing the plurality of core members, the buckling restraining assembly comprising:

a support tube; and a rigid layer and at least one air gap positioned between at least two core members or between at least one of the core members and the rigid layer.

2. The brace apparatus of claim 1, wherein the plurality of core members comprises a first core member and a second core member.

3. The brace apparatus of claim 1, wherein the plurality of core members comprises more than a two core members.

4. The brace apparatus of claim 2, wherein the first core member is coupled to one end of the buckling restraining assembly and the second core member is coupled to the other end of the buckling restraining assembly.

5. The brace apparatus of claim 2, wherein the first core member has a first deformable length and the second core member has a second deformable length, the effective deformable length of the brace apparatus comprising the sum of the effective deformable lengths of the first and second core members.

6. The brace apparatus of claim 5, wherein the core member can undergo a greater number of tension and compression cycles than a brace apparatus having a single core member of the same length.

7. The brace apparatus of claim 5, wherein the core member can undergo a greater amount of deformation than a brace apparatus having a single core member of the same length.

8. The brace apparatus of claim 1, wherein one or more of the plurality of core members has a variable width.

9. The brace apparatus of claim 8, wherein the variable width of the one or more core members controls deformation of the core member to prevent the premature restriction of the effective length of the core member.

10. A brace apparatus comprising:

a first and second core member adapted to absorb seismic magnitude forces by undergoing plastic deformation, each of the first and second core member having a deformable region;

a buckling restraining assembly having a first extremity and a second extremity, the buckling restraining assembly enclosing the first and second core members such that the first core member is coupled to the first extremity of the buckling restraining assembly and the second core member is coupled to the second extremity of the buckling restraining assembly, wherein the effective length of brace apparatus undergoing plastic deformation is the sum of the length of the deformable region of the first core member and the length of the deformable region of the second core member; and at least one air gap positioned between one of the first and second core members and the buckling restraining assembly.

11. The brace apparatus of claim 8, wherein the buckling restraining assembly includes a plurality of bearing members.

12. The brace apparatus of claim 11, wherein the plurality of bearing members are positioned around the first and second core members.

13. The brace apparatus of claim 11, wherein a bearing member is positioned between the first and second core members.

14. The brace apparatus of claim 11, wherein a plurality of bearing members are positioned between the first and second core members.

15. The brace apparatus of claim 11, wherein the plurality of bearing members minimize the friction between the first core member, the second core member, and the buckling restraining assembly.

16. The brace apparatus of claim 10, wherein a plurality of air gaps are positioned between the buckling restraining assembly and the first core member and the second core member.

17. The brace apparatus of claim 16, wherein an air gap is positioned between the first core member and the second core member.

18. The brace apparatus of claim 17, wherein a plurality of air gaps are positioned between the first core member and the second core member.

19. The brace apparatus of claim 17, wherein an air gap minimizes the friction between the first core member and the second core member.

20. The brace apparatus of claim 15, further comprising a plurality of spacers.

21. A brace apparatus adapted to absorb seismic magnitude forces by undergoing plastic deformation while maintaining the structural integrity of the brace, the brace apparatus being capable of undergoing a greater amount of deformation for a given length of the brace apparatus comprising:

a first core member having a first end, a second end, and a deformable region, the first core member being adapted to absorb seismic energy by undergoing plastic deformation, the first core member having a given deformation capacity;

a second core member having a first end, a second end, and a deformable region, the second core member being adapted to absorb seismic energy by undergoing plastic deformation, the second core member having a given deformation capacity;

a buckling restraining assembly circumscribing the first and second core members, the buckling restraining assembly comprising;

a support tube having a first end and a second end; and a rigid layer coupled to the support tube, wherein the second end of the first core member is coupled to one end of the buckling restraining assembly and the second end of the second core member is coupled to one end of the buckling restraining assembly such that the total deformation capacity of the brace apparatus is the sum of the deformation capacity of the first core member and the deformation capacity of the second core member;

at least one air gap positioned between the at least two core members or between at least one of the core members and the rigid layer.

22. The brace apparatus of claim 21, wherein the support tube is comprised of a plurality of plate members that are welded together.

23. The brace apparatus of claim 21, wherein the second end of the first core member is welded to the first end of the support tube and the second end of the second core member is welded to the second end of the support tube.

24. The brace apparatus of claim 21, wherein the second end of the first core member is coupled to the rigid layer at the first end of the brace apparatus and the second end of the second core member is coupled to the rigid layer at the second end of the brace apparatus.

25. A brace apparatus comprising:

a buckling restraining assembly comprising;

a support tube; and a rigid layer coupled to the support tube; and a first core member positioned internal to the buckling restraining assembly, the first core member being coupled to a first extremity of the buckling restraining assembly, wherein the first core member is adapted to absorb seismic magnitude forces by undergoing plastic deformation;

a second core member positioned internal to the buckling restraining assembly, the second core member being coupled to a second extremity of the buckling restraining assembly, wherein the second core member is adapted to absorb seismic magnitude forces by undergoing plastic deformation such that the effective length of brace apparatus undergoing plastic deformation is the sum of the length first core member undergoing plastic deformation and the length of the second core member undergoing plastic deformation at least one air gap positioned between the at least two core members or between at least one of the core members and the rigid layer.

26. The brace apparatus of claim 25, wherein the effective length of the brace apparatus undergoing plastic deformation is greater than the length of the brace apparatus.

27. The brace apparatus of claim 26, wherein the brace apparatus is able to undergo a greater number of tension and elongation cycles for a given amount of deformation that a single core brace having an effective length of the brace apparatus undergoing plastic deformation than is smaller than or equal to the length of the brace apparatus.

* * * * *